United States Patent [19]

Schook

[11] Patent Number: 4,566,690

[45] Date of Patent: Jan. 28, 1986

[54] DUMBELL AND BARBELL EXERCISE EQUIPMENT

[76] Inventor: Michael N. Schook, 121 Lycoming Dr., Coraopolis, Pa. 15108

[21] Appl. No.: 608,997

[22] Filed: May 10, 1984

[51] Int. Cl.[4] ..... A63B 13/00

[52] U.S. Cl. ..... 272/123; 272/122; 272/117

[58] Field of Search ..... 272/93, 117, 122, 123, 272/124, 116; 215/13 R, 200

[56] References Cited

U.S. PATENT DOCUMENTS

| | | | |
|---|---|---|---|
| 46,413 | 2/1865 | Windship . | |
| 259,752 | 6/1882 | Fisher, Jr. | 272/122 |
| 484,352 | 10/1892 | Ayton . | |
| 850,964 | 4/1907 | Pelletier et al. . | |
| 916,813 | 3/1909 | Whitney . | |
| 937,225 | 10/1909 | Burr . | |
| 1,119,169 | 12/1914 | Kepple . | |
| 1,536,048 | 5/1925 | Alastalo | 272/122 |
| 2,508,567 | 5/1950 | Dymeck | 272/123 |
| 3,241,209 | 3/1966 | Taylor | 215/13 R |
| 3,311,248 | 3/1967 | Marchant | 215/13 R |
| 3,341,045 | 9/1967 | Sandler | 215/13 R |
| 4,076,236 | 2/1978 | Ionel | 272/123 |
| 4,351,526 | 9/1982 | Schwartz | 272/122 |
| 4,361,324 | 11/1982 | Baroi | 272/123 |
| 4,482,151 | 11/1984 | Zwilling | 272/123 |

*Primary Examiner*—Richard J. Apley
*Assistant Examiner*—Robert W. Bahr
*Attorney, Agent, or Firm*—Webb, Burden, Robinson & Webb

[57] ABSTRACT

Weight training apparatus which includes an elongated handle and a plurality of separate weights mounted to each other and mounted to the handle is disclosed. The handle has a cylindrical male connector on each end and the weights each have a body portion with a cylindrical male and female connector on each side of the body portion. The diameter of the male connector is at least about one-half of the diameter of the body portion of the weights. Each weight preferably includes a cylindrical opening extending axially therethrough.

20 Claims, 10 Drawing Figures

DUMBELL AND BARBELL EXERCISE EQUIPMENT

DESCRIPTION

BACKGROUND OF THE INVENTION (1) Field of the Invention

This application relates to dumbell and barbell weight training and exercise equipment and, more particularly, to dumbell and barbell equipment with easily removable weights which may also be utilized on standard and Olympic sized bars.

(2) Description of the Prior Art

The more commonly used free weight training equipment, excluding the fixed weight type of exercise machines, are the solid, cast dumbells, and the free weight/bar combinations. Solid dumbells have the disadvantage that the weight is fixed and cannot be increased or decreased, thus requiring that a user purchase and store pairs of dumbells covering a wide range of weights. In addition, dumbells which are very heavy, i.e., in the range of 70 lbs. or more each, have the tendency to bend in the middle from use alone or from dropping the weights. Dropping the weights generally cannot be avoided by the serious weight trainer.

Free weight plates, mounted on a larger barbell or shorter dumbell bar, overcome many of the problems associated with solid dumbells. With one bar, a single pair of dumbell bars, and a variety of weights, barbells or dumbells of any weight can be assembled and a change from one weight to another can be easily effected. However, at least for dumbell bars, such weights must be secured to the bar by some means, typically by a removable collar. When training with very heavy weights, the collar often cannot withstand the stress concentrated on the collar from the weights and cannot adequately hold the weights in place.

Therefore, it is an object of the present invention to provide a weight training apparatus which utilizes easily changeable weights but in which the weights are secured thereto in order to withstand the stress involved from very heavy weights.

A variety of changeable weight exercise equipment, other than the common bar/plate combination, is known in the art. See, for example, U.S. Pat. Nos. 46,413; 259,752; 484,352; 850,964, 916,813; 937,225; 1,119,169; 1,536,048; 4,076,236; 4,351,526; 4,361,324. However, none of these references provides for weight training equipment which is specifically adapted to withstand the severe stresses involved when very heavy weights are being used. In addition, the various elements of these devices are designed to be used only in that particular equipment and are not adapted for use with other weight training equipment.

It is a further object of the present invention to provide a weight training apparatus which is specifically designed to withstand the stresses involved from very heavy weights, but which can also be used in connection with other, common weight training equipment.

SUMMARY OF THE INVENTION

Accordingly, I have invented a weight training apparatus which includes an elongated handle with a cylindrical male connector on each end and a plurality of weights mounted to the handle and to each other. Each weight includes a substantially right cylindrical body with a cylindrical male connector extending outwardly from one face of the body and a cylindrical female connector recessed into the opposite face of the body. The male connector is adapted to be joined to the female connector of another weight and join the weights together, and the female connector is adapted to engage the male connector on the handle. The diameter of the male connectors is at least about one half the diameter of the body of each of the weights. The weights may be easily assembled and disassembled and heavy weights may be supported by the connectors without bending or twisting or placing damaging stress on the connectors.

The male connectors are each preferably formed of an upstanding cylindrical lip with a single thread extending circumferentially about the outer surface of the lip. With such an arrangement weights may be joined together or to the handle with, at most, a one-quarter turn. The large size of the connector relative to the size of the weight facilitates the connection between two weights. The depth of each female connector is preferably slightly greater than the thickness of the cylindrical lip of the male connectors.

Each weight may include a cylindrical opening extending axially therethrough from the male connector to the female connector. The diameter of the opening is selected such that the weights may be positioned on preexisting weight training equipment, including a diameter of about $2\frac{1}{8}$ inches for an Olympic sized bar. The opening may be fitted with an adapter plug, which is a hollow cylindrical sleeve with an outer diameter about the same size as the diameter of the opening. The adapter plug preferably has an inner diameter of about $1\frac{1}{8}$ inches, thereby enabling a weight with an adapter plug to be used on a standard sized bar. The openings may also be provided with a solid filler plug which substantially fills the opening.

The handle may be provided in a variety of configurations, including a dumbell handle, a barbell handle or a curling bar handle.

DESCRIPTION OF THE PREFERRED EMBODIMENTS

Figure 1:
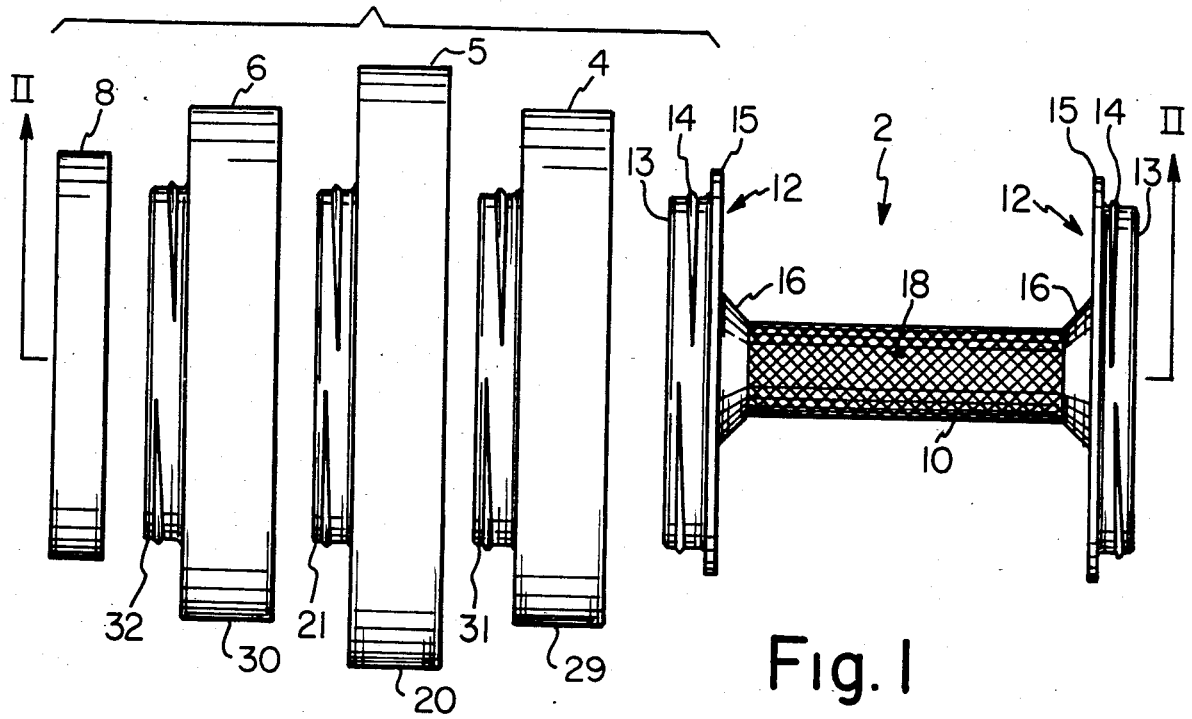
FIG. 1 is a side elevational view of one embodiment of a dumbell in accordance with the present invention.
Figure 2:
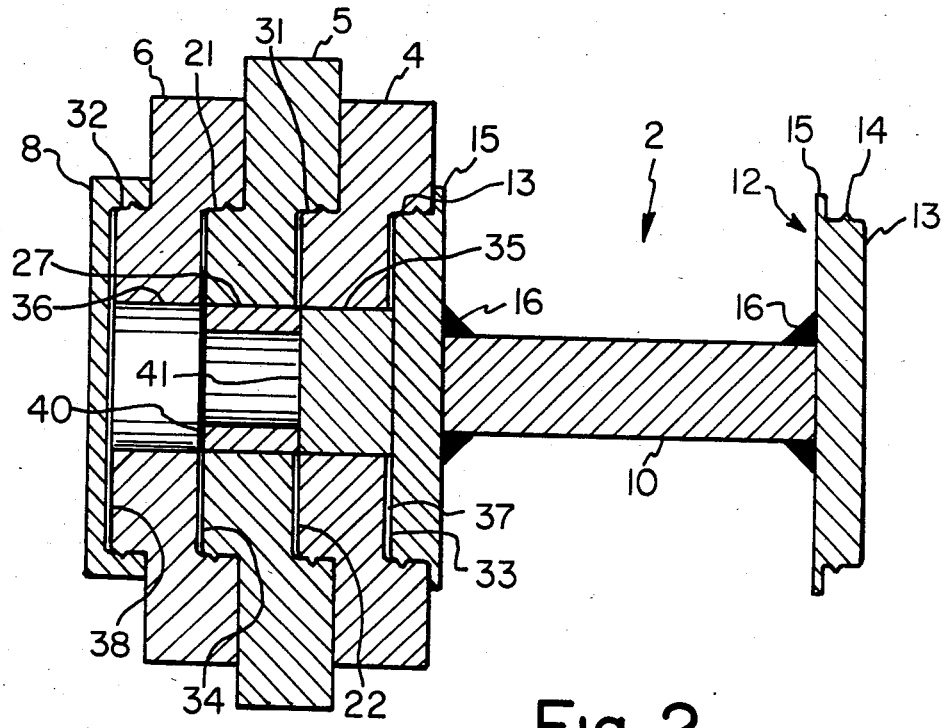
FIG. 2 is a section taken along lines II—II in FIG. 1.

Referring now to FIGS. 1 and 2, there is shown one embodiment of a dumbell in accordance with the present invention. The dumbell includes a central elongated dumbell handle 2 with one or more weights attached to each side of handle 2. For illustrative purposes three weights, namely, weight 4, weight 5, and weight 6 are shown attached to one side of handle 2 in FIGS. 1 and 2. However, it is to be understood that additional or fewer weights could be utilized and that an equal number of weights would be attached to the opposite side of handle 2. As will be described hereinafter in more detail, an end cap 8 may be attached to the outermost weight, as shown, weight 6.

Dumbell handle 2 includes a cylindrically shaped dumbell bar 10 with a male connector 12 provided on each end of dumbell bar 10. Male connector 12 includes a cylindrically shaped plate 13 with a single thread 14 extending circumferentially around the outer surface of plate 13. Plate 13 also has a stopper flange 15 extending circumferentially outwardly therefrom near the edge of plate 13 adjacent dumbell bar 10. Plate 13, thread 14 and stopper flange 15 are preferably molded in a single unit to form male connector 12. Male connector 12 is suitably joined to dumbell bar 10 by weld 16, although other means of connection may be used. Since the dumbell handle 2 will carry a large amount of weight at each end, preferably weld 16 should be of significant size with respect to the cross-section of dumbell bar 10 and male connector 12, and its outer surface should form a 45° angle therebetween. Dumbell bar 10 may include an outer knurled surface 18, as shown in FIG. 1, to aid in effectively gripping the dumbell.

Figure 3:
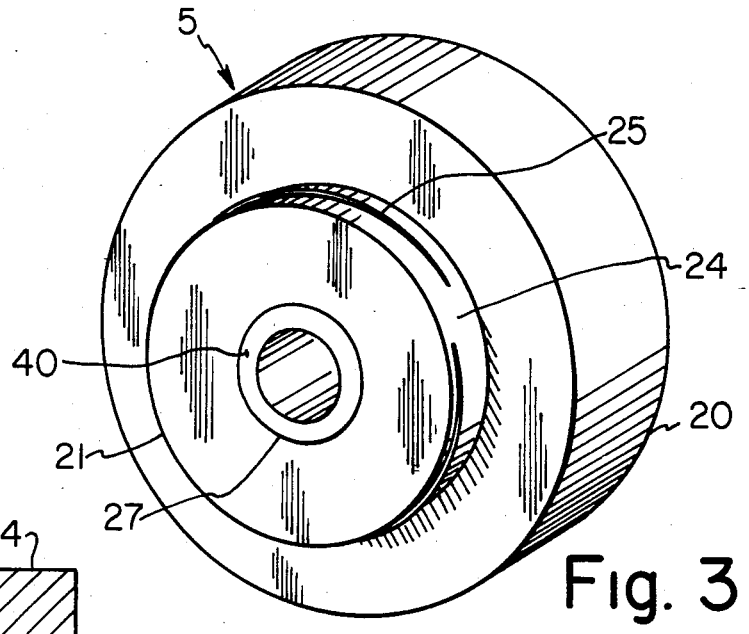
FIG. 3 is a perspective view of a weight.

Weights 4, 5, and 6 are of similar configuration, although the weights may be of different size and, hence, of different mass or actual weight. Referring now to FIGS. 1–3, weight 5 has a substantially right cylindrical body 20 with a male connector 21 extending upwardly from one face of body 20 and a female connector 22 recessed into the opposite face of body 20. Male connector 21 is formed of cylindrical lip 24 with a single thread 25 extending circumferentially about the outer surface of lip 24. Female connector 22 is preferably a cylindrical threaded recess with a diameter and thread configuration which is complementary to and adapted to engagingly receive male connector 21. In addition, male connector 21 is configured identically to plate 13 and thread 14 of male connector 12 on the dumbell handle 2. Weight 5 also has a central cylindrical opening 27 extending axially therethrough from male connector 21 to female connector 22.

Similarly, weights 4 and 6 each include, respectively, a body, 29 and 30, a male connector, 31 and 32, female connector, 33 and 34, and a central opening, 35 and 36.

The dumbell shown in FIGS. 1 and 2 may be easily assembled as follows: Weight 4 is positioned with female connector 33 adajcent male connector 12 on the dumbell handle 2. By rotating weight 4, or dumbell handle 10, female connector 33 will become threadedly joined to male connector 12 and, thus, securely join weight 4 to the dumbell handle 2. Similarly, weight 5 is connected to weight 4 by joining female connector 22 to male connector 31, and weight 6 is connected to weight 5 by joining female connector 34 to male connector 21. This same procedure is then repeated on the opposite side of the dumbell handle 2 to form a completed dumbell of a predetermined weight. By providing a single thread on the male and female connectors, a weight may be joined to the dumbell handle 2 or weights may be joined together by as little as a quarter turn of the weight or dumbell handle 2. In this manner, the dumbell may be assembled or the weight combination may be changed quickly and easily.

In addition, the weights are configured such that the outer diameter of the male connector of each weight is at least about one-half the outer diameter of the body portion. This relationship will reduce the downward twisting or bending force pulling at each male/female connector joint and will reduce the likelihood that the weights will become separated if the dumbell is dropped or from the weight of the entire dumbell. This is particularly important when it is desired to assemble a superheavy dumbell weighing upwards of 200 lbs. In addition, the connectors will not become damaged from the heavy weight due to the reduced stress on the connectors. It is also desirable to provide a relatively small outer diameter for the weights so that the dumbell does not prematurely make contact with the body and interfere with completing an exercise such as arm curls.

Furthermore, it is preferable to provide each female connector with a depth slightly greater than the thickness of a corresponding male connector. In this manner, the connectors will abut each other only along the outer circumference of the male connector and otherwise form a space therebetween when the weights are joined together. For example, space 37 is shown in FIG. 2 between weight 4 and weight 5. Also, with this arrangement it is insured that the body portions of adjacent weights will abut one another as shown in FIG. 2 and further reduce the stress on the connectors.

The dumbell shown in FIGS. 1 and 2 may include, as shown, an end cap 8 mounted onto the outer weight 6. End cap 8 is essentially a cylindrical plate larger in thickness and diameter than male connector 32 on weight 6. One face of end cap 8 includes female connector 38 recessed therein. Female connector 38 is identical to female connectors 22, 33, and 34 and permits end cap 8 to be threaded onto male connector 32 of weight 6. End cap 8 functions to both protect the otherwise exposed male connector 32 of weight 6 and to add additional weight to the assembled dumbell. The solid end cap 8 shown in FIGS. 1 and 2 also functions to prevent dirt or other matter from entering opening 36 in weight 6 and to otherwise protect opening 36 from damage.

The openings through the weights are provided to enable the weights to be used on other conventional weight training equipment, such as Olympic or standard sized barbells and dumbells. This will be explained hereinafter in connection with FIGS. 4 and 5. Ideally, the diameter of each opening is slightly larger than the outer diameter of the weight bearing portion of an Olympic sized barbell, or slightly larger than 2⅛ inches in diameter. However, when the weights are being used in the dumbell arrangement shown in FIGS. 1 and 2, the openings are not in use other than to reduce the final mass of the weights. The openings may be either left open, as shown by opening 36 in weight 6; be fitted with an adapter plug 40, as shown in opening 27 in weight 5; or be fitted with a filler plug 41, as shown in opening 35 in weight 4. Adapter plug 40 is a hollow cylindrical sleeve with an outer diameter about the same as, but no larger than, the diameter of opening 27. The adapter plug 40 has an inner diameter which is, preferably, slightly larger than the outer diameter of a standard sized bar. It can be appreciated that the adapter plug 40 both adds weight to weight 5 and also reduces the diameter of opening 27 to the inner diameter of the adapter plug 40. The filler plug 41 is a solid plug of the same approximate dimensions as opening 35 and functions to plug opening 35 and add a certain mass to weight 4.

The adapter plug 40 or filler plug 41 may be made of metal or rubber as desired. If formed of metal, they may be coated with the layer of rubber. In order to secure the plugs within the opening in a weight, the plugs may be provided with a tapered outer surface. Likewise, the surface of the openings through the weights may be coated with rubber or otherwise treated to increase the frictional contact between the weight and the plugs or between the weight and any bar the weight is mounted on.

A dumbell may be formed of weights with a variety of combinations of plugs placed within the openings in the weights. In the arrangement shown in FIG. 2, weight 4 includes a filler plug 41, weight 5 includes an adapter plug 40, and weight 6 includes no plug. In the dumbell arrangement shown in FIG. 4, weight 4 includes an adapter plug 40 in opening 35 and adjacent weight 5 also includes an adapter plug 40 in opening 27.

Figure 4:
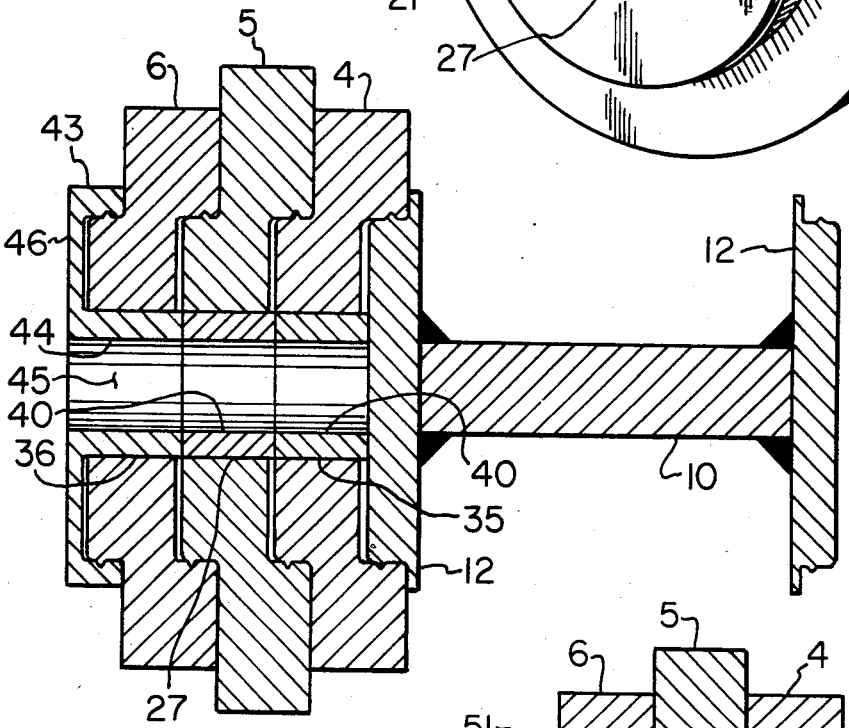
FIG. 4 is a cross sectional view of a second embodiment of a dumbell.

End cap 43 shown in FIG. 4 is a slight modification of end cap 8 shown in FIGS. 1 and 2. End cap 43 includes an integral cylindrical sleeve portion 44, similar in configuration to an adapter plug 40, which extends inwardly and into opening 36 of weight 6. Opening 45 within sleeve 44 extends through to the outer wall 46 of end cap 43. Sleeve 44 extends inwardly and abuts the adapter plug 40 within weight 5 and, likewise, the adapter plug 40 in weight 5 abuts the adapter plug 40 within weight 4. With the arrangement shown in FIG. 4, the adapter plug 40 in weights 4 and 5 will be held in position by end cap 43 and no rubber coating or the like is necessary on the outer surface of the adapter plugs. Similarly, the adapter plug 40 in weights 4 or 5, or both, could be replaced in FIG. 4 by a loosely fitting filler plug 41 and the filler plug(s) 41 would be held securely in place within the dumbell by the sleeve portion 44 of end cap 43.

Figure 5:
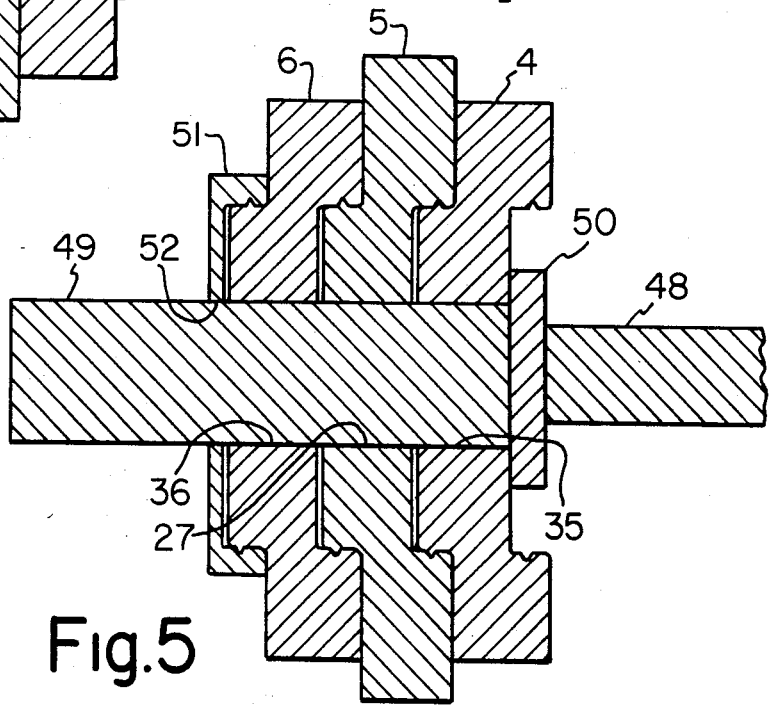
FIG. 5 is a cross sectional view of one end of an Olympic bar with weights mounted thereto.
Figure 6:
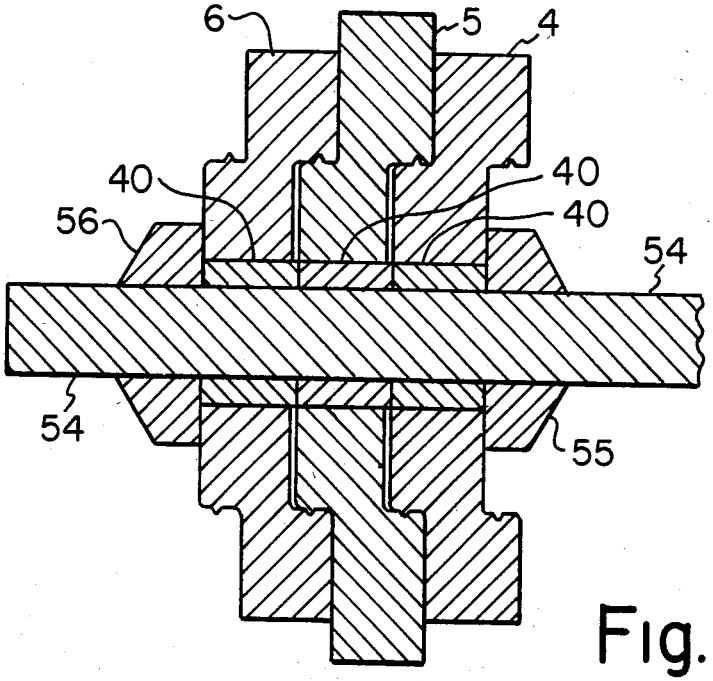
FIG. 6 is a cross sectional view of one end of a standard bar with weights mounted thereto.

As mentioned above, the weights of the present invention may also be easily used in conjunction with existing weight training equipment. FIGS. 5 and 6 show weights 4, 5, and 6 mounted on an Olympic bar and a standard bar, respectively. The end of the Olympic bar shown in FIG. 5 includes a bar portion 48, a wider weight bearing portion 49, and a fixed collar 50 mounted therebetween and under the weight bearing portion 49. Weights 4, 5, and 6 are utilized with no adapter plug 40 or filler plug 41 located within central openings 35, 27, and 36, respectively. Initially, weight 4 is placed, via opening 35, over weight bearing portion 49 and moved inwardly until it rests against the fixed collar 50. Then weight 5 is placed over weight bearing portion 49, moved up against weight 4, and turned to join weight 4 and weight 5 together. Similarly, weight 6 is joined to weight 5 on weight bearing portion 49. Although the weights could be joined together before being positioned on the Olympic bar, it is preferable, due to the heavy weights involved, to handle only one weight at a time. End cap 51 may then be positioned on weight 6 as shown. End cap 51 is similar to end cap 8, except that end cap 51 includes opening 52 therethrough which enables end cap 51 to pass over the weight bearing portiion 49. It will be appreciated that opening 52 must have a diameter as large as or larger than the diameter of the weight bearing portion 49, or larger than about 2⅛ inches. Generally, no additional collar is used to hold the weights in place on an Olympic bar, although such a collar could be used if desired.

The standard sized bar 54 shown in FIG. 6 is an elongated, cylindrical bar having a constant diameter along its entire length. Weights are generally held in place on each end of the standard bar 54 by a pair of removable collars 55 and 56. Collars are held in place by screws or the like (not shown), as is well known in the art. Each of the weights 4, 5, and 6 is fitted with an adapter plug 40. Generally, the inner collar 54 is fitted in place on the bar 54 where desired, and weights 4, 5, 6 are placed over the end of the bar 54 in the same manner in which the weights were mounted on the Olympic bar as discussed in connection with FIG. 5. In the example shown in FIG. 6, no end cap is placed over weight 6, although an end cap similar to end cap 51, but with a correspondingly smaller opening therethrough, could be used if desired. Then outer collar 56 is placed against weight 6 and secured to the bar 54.

The dumbell handle 2 discussed in connection with FIGS. 1, 2 and 4 can be made sufficiently long and the invention used as a barbell. The arrangement, other than the extended length of the dumbell handle 2, would be identical to that already discussed. The same weight and weight mounting arrangement can also be used to form other weight lifting equipment, such as on curling bars, tricep exercising bars, or the like.

Figure 7:
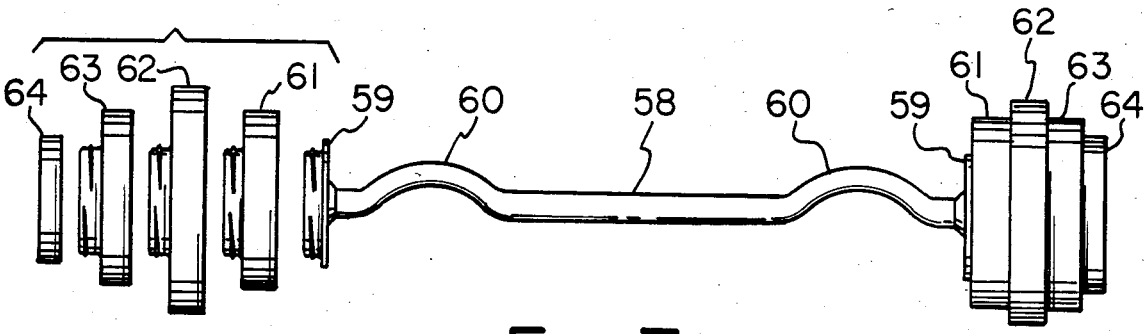
FIG. 7 is a side elevational view of one embodiment of a curling bar.

A curling bar in accordance with the present invention is shown in FIG. 7. The curling bar includes a curling bar handle 58, which is an elongated bar with a male connector 59 provided on each end. The curling bar handle 58 is characterized by a pair of spaced curved areas 60 which permit the curling bar to be grasped and used in curling exercises without placing an undue amount of strain on the user's wrists. The curling bar has one or more weights attached to each end of the curling bar handle 58. As shown illustratively in FIG. 7, weights 61, 62 and 63 and end cap 64 are attached to each other and to each end of the curling bar handle 58 by means of the male connector 59 to form a completed curling bar of a predetermined weight. Male connector 59 is identical to male connector 12 discussed above, and weights 61, 62, and 63 and end cap 64 are identical to weights 4, 5, and 6 and end cap 8, respectively, discussed in connection with FIGS. 1 and 2.

Figure 8:
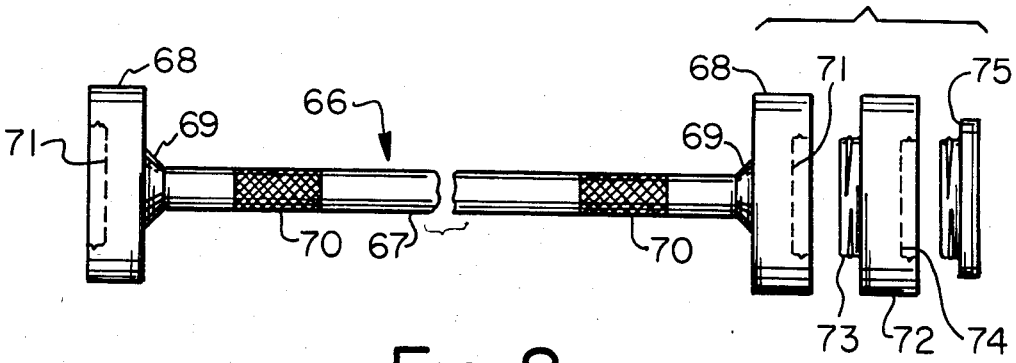
FIG. 8 is a side elevational view of one embodiment of a barbell arrangement.

Another use of the present invention, illustrating its wide versatility, is shown in FIG. 8. FIG. 8 shows, as is known in the art, a barbell handle 66 formed of an elongated straight bar 67 with a cylindrical shaped weight 68 attached to each end of bar 67 by weld 69 or the like. Bar 67 may be provided with a pair of spaced knurled areas 70 to aid in a user's gripping the bar 67. The face of each weight 68 opposite the bar is provided with a recessed female connector 71 identical to female connectors 22, 33, and 34 discussed above. With such a barbell handle arrangement, one or more weights of the present invention, weight 72 as shown, may be mounted on the barbell handle 66 by merely orienting male connector 73 of weight 72 toward the barbell handle 66 and securing male connector 73 within female connector 71. The outwardly oriented female connector 74 of weight 72 may be covered with end cap 75.

Figure 9:
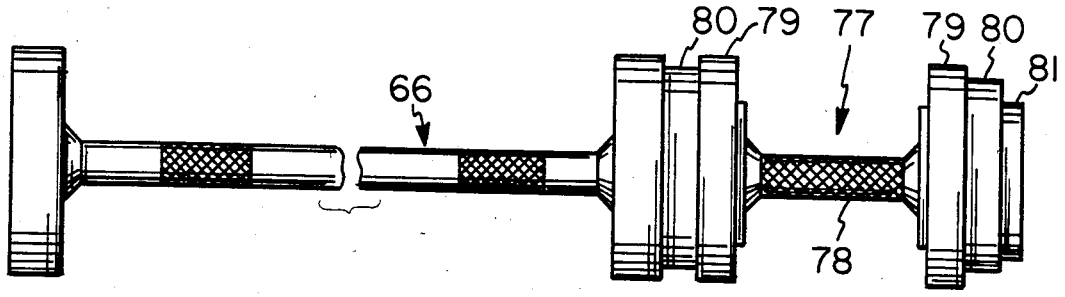
FIG. 9 is a side view of the barbell shown in FIG. 8 with a dumbell attached to one end.

FIG. 9 shows the barbell handle 66 of FIG. 8 with a dumbell 77 of the present invention attached to one side. It is to be understood that when in actual use a like dumbell 77 will be attached to both sides of the barbell handle 66. Dumbell 77 as shown in FIG. 9 includes a dumbell handle 78 and weight 79 and 80 attached to each side of handle 78. Weight 80 adjacent barbell handle 66 has male connector (not shown) on its outer surface which is matingly engaged with female connector 71 of weight 68 to join the dumbell 77 to the barbell handle 66. The male connector on the opposite weight 80 may be covered with end cap 81. This arrangement enables a barbell of very heavy weight to be constructed and provides a gripping means at each outer end of the barbell, namely, dumbell handle 78, to enable two weight lifters to grasp the barbell and raise it up onto a bench press, squat stands, or the like, or even to raise it directly to the shoulders of another weight lifter. The use of two spotters to maneuver, or even steady, a weight is quite common when very heavy weights are being used. The arrangement shown in FIG. 9 greatly facilitates the work of such spotters.

Figure 10:
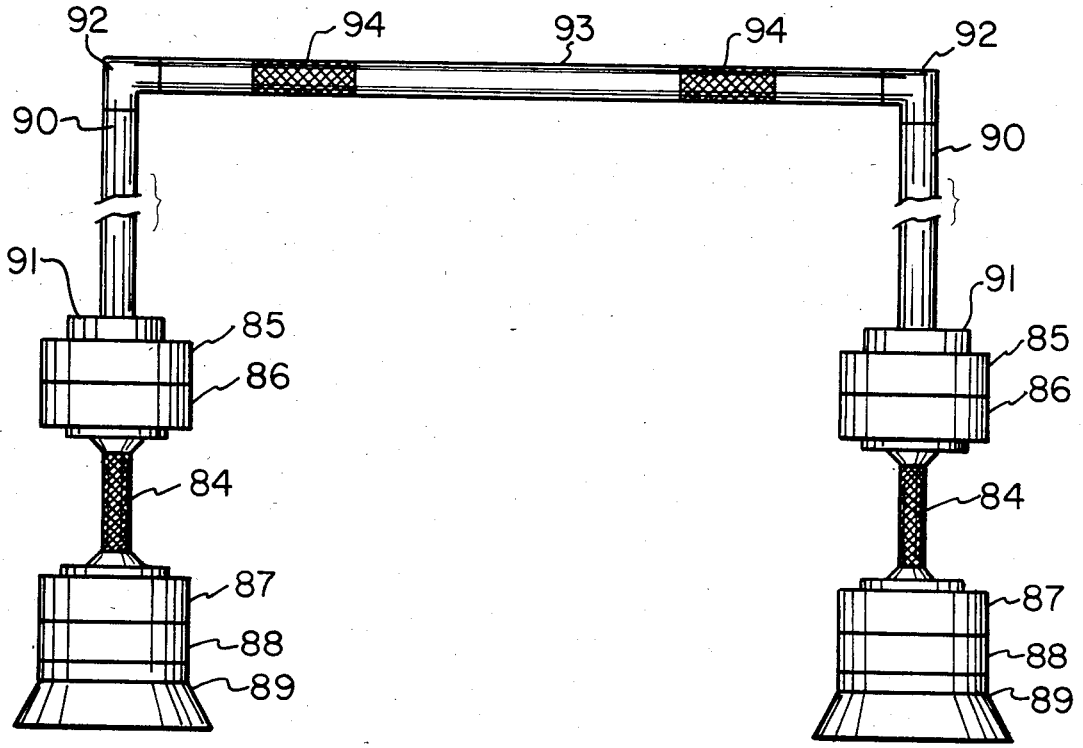
FIG. 10 is a side elevational view of a chin-up bar.

Referring now to FIG. 10, the exercise equipment of the present invention can also be used to construct a chin-up bar. The chin-up bar includes a pair of dumbell handles 84, each of which have, as shown, two weights mounted on each side, namely, weights 85, 86, 87 and 88. The dumbells are spaced apart and oriented in a vertial manner and the lowermost dumbell weight, here weight 88, is mounted to a base plate 89. Base plate 89 is essentially another weight which includes a female connector (not shown) for mating with the male connector on weight 83 and flares out at the bottom to provide a stable base for the chin-up bar assembly. An upright pipe 90 is mounted to the male connector on the uppermost weight on each dumbell, here weight 85, by an internally threaded sleeve 91. An L connector 92 is mounted to the top of each upright pipe 90 and a horizontal pipe 93 extends between and is attached to the L connector. Horizontal pipe 93 may be provided with a pair of spaced knurled areas 94. The height of the horizontal pipe may be set by the particular length of the upright pipe 90 used or may be adjusted up or down by the number of weights connected to dumbell handle 84. By providing a sufficiently short upright pipe, this same arrangement can be used for bench pressing or squat exercising and will eliminate the necessity of the weight lifter having another person function as a spotter. The equipment shown in FIG. 10 can also be used for dips by replacing the upright pipes 90 with handles and the dumbell handles 84 spaced appropriately for the size of the user.

The weights may be formed as a solid unit from a cast metal or the like to the desired weight. The maximum outer diameter of the weights is preferably about 8 inches to enable the handle carrying the weights to be moved close to the body when in use. One example of a weight in accordance with the present invention would include an outer diameter of the body of the weight of 8 inches and a diameter of the male and female connectors of 4 inches. Another example of a weight would include an outer diameter of 7 inches and a connector diameter of $3\frac{1}{2}$ inches. Minor deviations from these diameters for the weight and the connectors may be made without departing from the advantages of the present invention.

Having described the presently preferred embodiments of the invention, it is to be understood that it may be otherwise embodied within the scope of the appended claims.

I claim:

1. Weight training apparatus comprising:

(a) an elongated handle having a cylindrical male connector on each end of said handle, (b) a plurality of weights adapted to be mounted both to said handle and to each other, each of said weights including a substantially right cylindrical body with a cylindrical male connector extending outwardly from one face of the body and a cylindrical female connector recessed into the opposite face of the body, said male connector of each weight adapted to be joined to the female connector of another weight and thereby join said weights together, and said female connector of each weight adapted to engage said male connector on the handle and thereby join a weight to said handle, (c) the diameter of the male connector of each weight and the male connector of the handle being at least about one-half of the diameter of the body of each of said weights, whereby the weights are easily assembled and disassembled and are supported by said connectors without bending or twisting or placing damaging stress on said connectors.

2. The weight training apparatus of claim 1 wherein the male connector on each of said weights and the male connector on said handle are each formed of an upstanding cylindrical lip mounted thereto with a single thread extending circumferentially about the outer surface of said lip whereby weights may be joined together or joined to said handle by no more than a one-quarter turn.

3. The weight training apparatus of claim 2 wherein the depth of the female connector on each of said weights is slightly greater than the thickness of said cylindrical lip.

4. The weight training apparatus of claim 2 wherein each of said weights further includes a central cylindrical opening extending axially therethrough from said male connector to said female connector.

5. The weight training apparatus of claim 4 wherein the diameter of said opening is selected such that said weights may be positioned on preexisting weight training equipment.

6. The weight training apparatus of claim 5 wherein the diameter of said opening is larger than the outer diameter of the weight bearing portion of an Olympic sized bar.

7. The weight training apparatus of claim 6 wherein the diameter of said opening is about $2\frac{1}{8}$ inches.

8. The weight training apparatus of claim 4 further comprising an adapter plug mounted within said opening, said adapter plug being a hollow cylindrical sleeve with an outer diameter about the same as the diameter of said opening.

9. The weight training apparatus of claim 8 wherein the inner diameter of said adapter plug is larger than the outer diameter of a standard sized bar.

10. The weight training apparatus of claim 9 wherein the inner diameter is about $1\frac{1}{8}$ inches.

11. The weight training apparatus of claim 4 wherein said openings include a solid filler plug mounted therein which substantially fills said opening.

12. The weight training apparatus of claim 2 wherein said handle is a dumbell handle.

13. The weight training apparatus of claim 2 wherein said handle is a barbell handle.

14. The weight training apparatus of claim 2 wherein said handle is a curling bar handle.

15. Weight training apparatus comprising:

(a) an elongated handle having a cylindrical male connector on each end of said handle, (b) a plurality of weights adapted to be mounted both to said handle and to each other, each of said weights including a substantially right cylindrical body with a cylindrical male connector extending outwardly from one face of the body and a cylindrical female connector recesses into the opposite face of the body, said male connector of each weight adapted to be joined to the female connector of another weight and thereby join said weights together, said female connector of each weight adapted to engage said male connector on the handle and thereby join a weight to said handle, and with each of said weights including a central cylindrical opening extending axially therethrough from said male connector to said female connector, (c) the diameter of the male connector of each weight and the male connector of the handle being at least about one-half of the diameter of the body of each of said weights, whereby the weights are easily assembled and disassembled and are supported by said connectors without bending or twisting or placing damaging stress on said connectors.

16. The weight training apparatus of claim 15 wherein the male connector on each of said weights and the male connector on said handle are each formed on an upstanding cylindrical lip mounted thereto with a single thread extending circumferentially about the outer surface of said lip whereby weights may be joined together or joined to said handle by no more than a one-quarter turn.

17. The weight training apparatus of claim 16 wherein the diameter of said opening is selected such that said weights may be positioned on preexisting weight training equipment.

18. The weight training apparatus of claim 16 further comprising an adapter plug mounted within said opening, said adapter plug being a hollow cylindrical sleeve with an outer diameter about the same as the diameter of said opening.

19. The weight training apparatus of claim 18 wherein the inner diameter of said adapter plug is larger than the outer diameter of a standard sized bar.

20. The weight training apparatus of claim 16 wherein said opening includes a solid filler plug mounted therein which substantially fills said opening.

* * * * *

UNITED STATES PATENT AND TRADEMARK OFFICE

CERTIFICATE OF CORRECTION

PATENT NO. : 4,566,690

DATED : January 28, 1986

INVENTOR(S) : Michael N. Schook

It is certified that error appears in the above-identified patent and that said Letters Patent is hereby corrected as shown below:

Column 6 Line 41 "cylindrical" should read --cylindrically--.

Column 7 Line 19 "83" should read --88--.

In the Claims:

Claim 15 - Column 8 Line 66 "recesses" should read --recessed--.

Claim 16 - Column 9 Line 18 "on" (second occurrence) should read --of--.

Signed and Sealed this

*Twenty-ninth* Day of *April 1986*

[SEAL]

*Attest:*

DONALD J. QUIGG

*Attesting Officer*

*Commissioner of Patents and Trademarks*